US011135708B2

(12) United States Patent
Arai et al.

(10) Patent No.: US 11,135,708 B2
(45) Date of Patent: Oct. 5, 2021

(54) SCREW FEEDING/FASTENING UNIT OF CONTINUOUS SCREW FASTENING DEVICE

(71) Applicant: MURO CORPORATION, Utsunomiya (JP)

(72) Inventors: Kunihiro Arai, Utsunomiya (JP); Isamu Arai, Utsunomiya (JP)

(73) Assignee: MURO CORPORATION, Utsunomiya (JP)

( * ) Notice: Subject to any disclaimer, the term of this patent is extended or adjusted under 35 U.S.C. 154(b) by 393 days.

(21) Appl. No.: 16/204,184

(22) Filed: Nov. 29, 2018

(65) Prior Publication Data

US 2019/0176305 A1 Jun. 13, 2019

(51) Int. Cl.
*B25B 23/04* (2006.01)

(52) U.S. Cl.
CPC ..... *B25B 23/045* (2013.01)

(58) Field of Classification Search
CPC ..... B25B 23/04; B25B 23/045; B25B 23/00–23/18; B25B 21/00; B23P 19/06; F16B 27/00
See application file for complete search history.

(56) References Cited

U.S. PATENT DOCUMENTS 5,855,151 A * 1/1999 Habermehl ..... B25B 23/045 81/434
6,109,146 A * 8/2000 Muro ..... B25B 23/045 81/434

FOREIGN PATENT DOCUMENTS

JP 3333114 B 7/2002

* cited by examiner

*Primary Examiner* — Robert J Scruggs
(74) *Attorney, Agent, or Firm* — Tracy M. Heims; Apex Juris, pllc.

(57) ABSTRACT

The present invention provides a screw feeding/fastening unit of a continuous screw fastening device which enables assuredly pulling screws out of a screw strip in tandem with a screw fastening operation even in case of using the screws each of which has, e.g., a flat shape below its head portion.

A screw feeding/fastening device of a continuous screw fastening device according to the present invention is a screw feeding/fastening unit 1 of a continuous screw fastening device which fastens screws 4, and it is configured to include a screw strip binding piece unbinding section 51 which supports a screw strip guide unit 2 to be rotatable in a direction orthogonal to a longitudinal direction of a bit by a shaft body 53 provided at a position before a feed case 22 in a feeder unit 21 and to be restorable to its original position by a spring 54, has on the screw strip guide unit a turning receiver 6 which abuts on a part of a slide frame and receives turning force at the time of a slide operation of the slide frame 31 toward the screw strip guide unit, and turns the screw strip guide unit together with the turning receiver around the shaft body as a spindle in a direction along which a tip side gets away from a screw at the fastening acting position to impart unbinding force to a screw strip binding piece 3*a* at the time of fastening the screw.

6 Claims, 16 Drawing Sheets

(SCREW STRIP SUPPORT)

(AT FEEDING SCREW)

(AT FASTENING LAST COUPLED SCREW)

SCREW FEEDING/FASTENING UNIT OF CONTINUOUS SCREW FASTENING DEVICE

BACKGROUND OF THE INVENTION

1. Field of the Invention

The present invention relates to a screw feeding/fastening unit of a continuous screw fastening device, and more particularly to a screw feeding/fastening unit of a continuous screw fastening device which enables precise pulling of screws each having a flat shape below its head portion, out of a screw strip in tandem with a screw fastening operation even in case of using such screws.

2. Description of the Related Art

In feeding screws bound to a screw strip to a fastening position and driving a bit to rotate so that a screw is fastened in target position with conventional continuous screw fastening devices, screws easily punch out of the screw strip. When the screws have a plate-like or horn-like screw head portion, it is difficult to pull screws out of the screw strip in tandem when the screws are flat shape below the head portion, such as hexagon or wafer headed screws, bearing surfaces of the head portions caught by the screw strip, or the screw strip are often deformed, and hence the screw fastening to a target position is impaired.

The applicant of the present application in Invention I has previously described a continuous screw fastening device configured in such a manner that a pressing section which abuts on a lower portion of a screw strip guide near an axial hole is provided. The screws in the latter fastening device protrudes on the main body side, a guide path side of the screw strip guide is pushed up by the pressing section, and a screw strip inserted through the guide path can be lifted up in tandem with a fastening operation of the bit. Although the latter screw strip lifting structure provided improvements over the prior art, a residual problem of screws pulling through resulting in the vacant screw strip alone being torn off and interruption of projects persist.

A further problem with the screw strip lifting structure which is held by the last screw, when fastening the last coupled screw which is bound to the screw strip, the screw strip cannot be held by a subsequent screw since there is no subsequent screw. Therefore, the screw strip cannot be removed from the last coupled screw, and the last coupled screw is not used and therefore wasted.

Furthermore, in conventional continuous screw fastening devices, the bit can be replaced where an attachment has been removed from a driver when using a cross bit or a square bit. However, due to its large diameter, replacing a hexagonal bit entails removal of both the socket and bit and hence the bit replacement is troublesome.

Patent Literature 1: Japanese Patent No. 3333114

The present invention addresses such and other drawbacks of conventional screw fastening systems. In particular, the present invention provides a screw feeding/fastening unit for continuous screw fastening which enables precisely pulling screws out of a screw strip in tandem with a screw fastening operation even in case of using the screws with a flat head portion and to consistently pull the screw strip from a last coupled screw, and simplifies and facilitates replacement of a bit even if using a hexagonal or similar bit having a large diameter at its end portion.

SUMMARY OF THE INVENTION

The present invention provides a screw feeding/fastening unit of a continuous screw fastening device, including: a screw strip guide unit which guides many screws bound to a screw strip at predetermined intervals to a fastening acting position for a target, and leads a part of the screw strip subjected to screw fastening forward for discharge; a target abutting body configured to enable piercing a screw to be fastened therethrough which is arranged immediately below the fastening acting position; a feeder unit which includes in a coupling arrangement a feed case arranged above the screw strip guide unit and a guide tube which is arranged on one lateral side of the screw strip guide unit and has a lower portion coupled with the target abutting body, and which includes a turnable feed lever for screw feeding which is arranged to reach the vicinity of the fastening acting position from the inside of the feed case through an outer surface of the screw strip guide unit; and a slide frame to which a screw fastening driver is attached from above, into which a bit coupled with a rotation main shaft body of the driver is inserted, and which is slidably fitted to the feed case, engages a tip of the bit with a screw head at the fastening acting position to enable screw fastening in correspondence with a slide operation toward the screw strip guide unit side, imparts turning force to the feed lever to return it to a subsequent screw feed position, and imparts the turning force the feed lever to feed a subsequent screw to the fastening acting position in correspondence with a slide operation toward an original position, the invention being mainly characterized in that the screw feeding/fastening unit of the continuous screw fastening device includes a screw strip binding piece unbinding section which supports the screw strip guide unit to be rotatable in a direction orthogonal to a longitudinal direction of the bit by a shaft body provided at a position before the feed case of the feeder unit and to be restorable to its original position by a spring, has on the screw strip guide unit a turning receiver which abuts on a part of the slide frame and receives turning force at the time of a slide operation of the slide frame toward the screw strip guide unit, and turns the screw strip guide unit together with the turning receiver around the shaft body as a spindle in a direction along which a tip side gets away from a screw at the fastening acting position to impart unbinding force to the screw strip binding piece at the time of fastening the screw.

According the invention of claim 1, it is possible to realize and provide a screw feeding/fastening unit of a continuous screw fastening device which enables assuredly pulling screws out of a screw strip binding piece in tandem with a screw fastening operation even in case of using the screws each having a flat shape below its head portion.

According to the invention of claim 2, it is possible to realize and provide a screw feeding/fastening unit of a continuous screw fastening device which enables assuredly pulling a screw strip binding piece out of a last coupled screw in many screws bound by a screw strip.

The present invention as recited in claim 3 provides a screw feeding/fastening unit of a continuous screw fastening device which enables simplifying and facilitating replacement of bits and has excellent replacement workability even in case of using the bits such as a hexagonal bit having a large diameter at its end portion.

According to the invention of claim 4, it is possible to realize and provide a screw feeding/fastening unit of a continuous screw fastening device which enables assuredly pulling screws out of a screw strip binding piece in tandem with a screw fastening operation even in case of using the screws each having a flat shape below its head portion, and also enables assuredly pulling the screw strip binding piece out of a last coupled screw in many screws bound by a screw strip.

According to the invention of claim 5, it is possible to realize and provide a screw feeding/fastening unit of a continuous screw fastening device which enables assuredly pulling a screw strip binding piece out of a last coupled screw in many screws bound by a screw strip, and also enables simplifying and facilitating replacement of bits and has excellent replacement workability even in case of using the bits such as a hexagonal bit having a large diameter at its end portion.

According to the invention of claim 6, it is possible to realize and provide a screw feeding/fastening unit of a continuous screw fastening device which enables assuredly pulling screws out of a screw strip binding piece in tandem with a screw fastening operation even in case of using the screws each having a flat shape below its head portion, and also enables simplifying and facilitating replacement of bits and has excellent replacement workability even in case of using the bits such as a hexagonal bit having a large diameter at its end portion.

According to the present invention of claim 7, it is possible to realize and provide a screw feeding/fastening unit of a continuous screw fastening device which enables assuredly pulling screws out of a screw strip binding piece in tandem with a screw fastening operation even in case of using the screws each having a flat shape below its head portion, enables assuredly pulling the screw strip binding piece out of a last coupled screw in many screws bound by a screw strip, and also enables simplifying and facilitating replacement of bits and has excellent replacement workability even in case of using the bits such as a hexagonal bit having a large diameter at its end portion.

DETAILED DESCRIPTION OF THE PREFERRED EMBODIMENT

Figure 1:
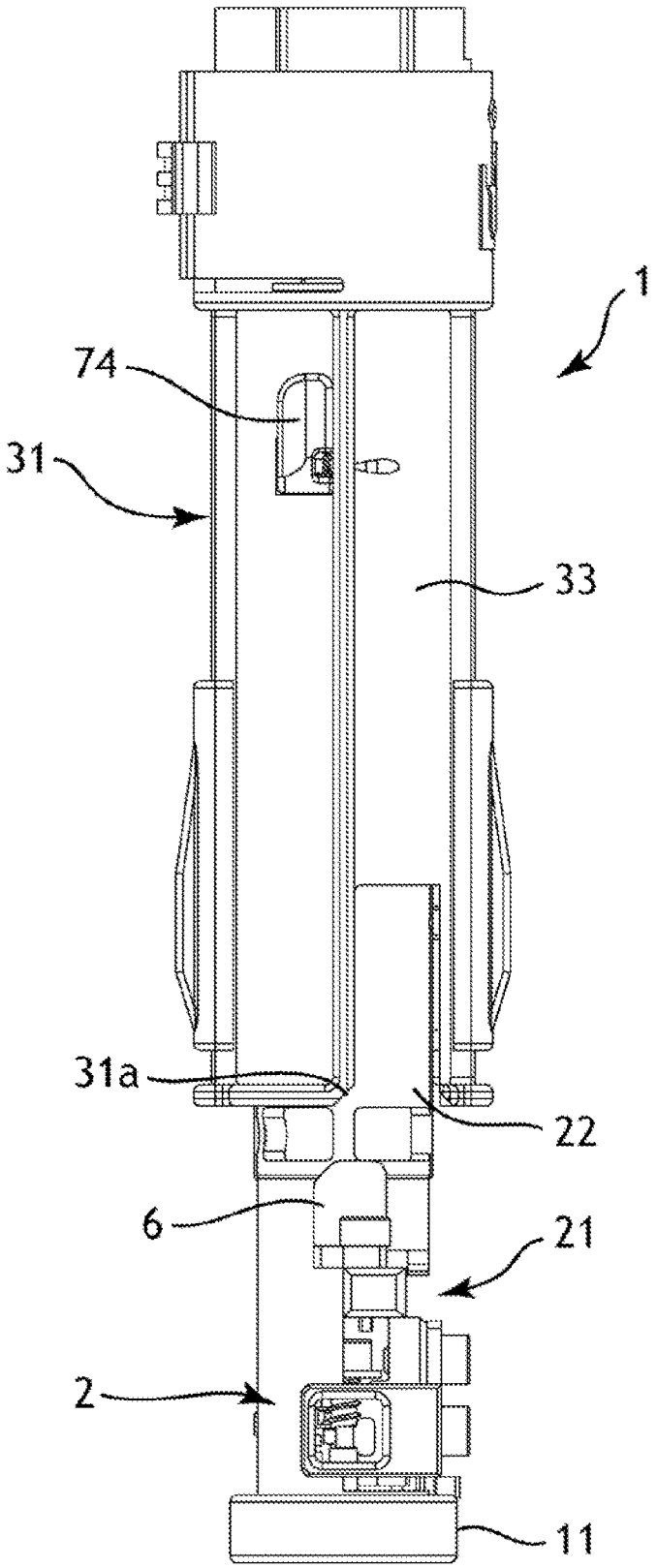
FIG. 1 is a schematic front view of a screw feeding/fastening unit of a continuous screw fastening device according to an example of the present invention.
Figure 2:
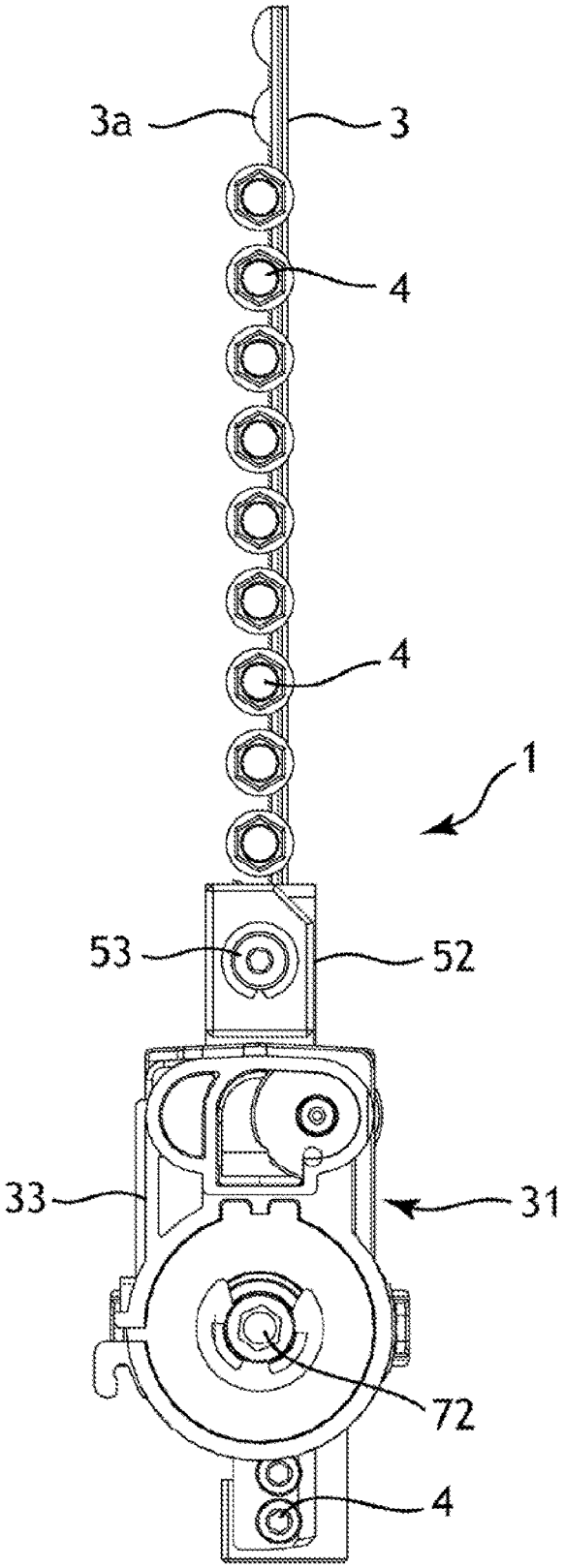
FIG. 2 is a schematic plan view of the screw feeding/fastening unit of the continuous screw fastening device according to the example.

According to the present invention, an object to realize and provide a screw feeding/fastening unit of a continuous screw fastening device which enables assuredly pulling screws out of a screw strip in tandem with a screw fastening operation even in case of using the screws each having, e.g., a flat shape below its head portion, assuredly pulling the screw strip out of a last coupled screw, and simplifying and facilitating replacement of bits even in case of using the bits like a hexagonal bit having a large diameter at its end portion is attained by a screw feeding/fastening unit of a continuous screw feeding device, including: a screw strip guide unit which guides many screws bound to a screw strip at predetermined intervals to a fastening acting position for a target, and leads a part of the screw strip subjected to screw fastening forward for discharge; a target abutting body configured to enable piercing a screw to be fastened therethrough which is arranged immediately below the fastening acting position; a feeder unit which includes in a coupling arrangement a feed case arranged above the screw strip guide unit and a guide tube which is arranged on one lateral side of the screw strip guide unit and has a lower portion coupled with the target abutting body, and which includes a turnable feed lever for screw feeding which is arranged to reach the vicinity of the fastening acting position from the inside of the feed case through an outer surface of the screw strip guide unit; and a slide frame to which a screw fastening driver is attached from above, into which a bit coupled with a rotation main shaft body of the driver is inserted, and which is slidably fitted to the feed case, engages a tip of the bit with a screw head at the fastening acting position to enable screw fastening in correspondence with a slide operation toward the screw strip guide unit side, imparts turning force to the feed lever to return it to a subsequent screw feed position, and imparts the turning force the feed lever to feed a subsequent screw to the fastening acting position in correspondence with a slide operation toward an original position, the screw feeding/fastening unit of the continuous screw fastening device being configured include: a screw strip binding piece unbinding section which supports the screw strip guide unit to be turnable in a direction orthogonal to a longitudinal direction of the bit by a shaft body provided at a position before the feed case of the feeder unit and to be restorable to its original position by a spring, has on the screw strip guide unit a turning receiver which abuts on a part of the slide frame and receives turning force at the time of a slide operation of the slide frame toward the screw strip guide unit, and turns the screw strip guide unit together with the turning receiver around the shaft body as a spindle in a direction along which a tip side gets away from a screw at the fastening acting position to impart unbinding force to the screw strip binding piece at the time of fastening the screw; a screw strip support mechanism section provided on a bottom portion of the screw strip guide unit and formed of a turning claw body which is supported to be turnable by an action of spring force, retracts from a path of the screws at the time of screw feeding performed by the feeder unit, abuts on and supports a bottom of the screw strip between screws which are adjacent to each other at the end of the screw feeding, and includes at a protruding end an abutting claw piece which abuts on and supports the bottom of the screw strip near the fastening acting position; and a bit/sleeve release mechanism section to which the bit is detachably coupled through a sleeve disposed to a socket directly connected to the rotation main shaft body of the driver in the slide frame, and which includes a sleeve release lever which is arranged on an outer wall portion of the slide frame to enable a manual operation and a sleeve release piece which uncouples the bit and the sleeve from each other in correspondence with an operation of the sleeve release lever.

Example

A screw feeding/fastening unit of a continuous screw fastening device according to an example of the present invention will now be described hereinafter in detail with reference to the drawings.

As shown in FIG. 1 to FIG. 5, a screw feeding/fastening unit 1 of a continuous screw fastening device according to this example has: a screw strip guide unit 2 which guides many screws 4 bound by a screw strip 3 at predetermined intervals to a fastening acting position for a target, has a square tubular shape to guide a part of the screw strip 3 subjected to the screw fastening forward for discharge, is opened on an inlet side and an outlet side of the screw strip 3, includes an operation opening region for a later-described feed lever 24 on one lateral side, and includes a screw strip guide tube 5 whose bottom side is opened in a longitudinal direction; a target abutting body 11 which is made of, e.g., a rubber material through which a screw 4 to be fastened arranged immediately below the fastening acting position can be inserted and has a U-like shape as seen in plan (or as seen in bottom); a feeder unit 21 which includes a feed case 22 arranged on an upper side of the screw strip guide unit 2 and a guide tube 23 which is arranged on one lateral side of the screw strip guide unit 2 and has a lower portion coupled with the target abutting body 11 in a coupling arrangement, and also includes a feed lever 24 which is provided with a feed latch 25 engaged with a side surface portion of each screw 4 fed to the fastening acting portion at a lower end portion thereof in an arrangement extending from the inside of the feed case 22 to the vicinity of the fastening acting position through an outer side of the one lateral side of the screw strip guide unit 2 and which is also pivotally supported in the feed case 22 to enable turning; and a slide frame 31 to which a later-described driver 41 for screw fastening is attached from above, into which a bit 32 coupled with a rotation main shaft body of the driver 41 is inserted, which is slidably fitted to the feed case 22, moves down the bit 32 in correspondence with a slide operation toward the screw strip guide unit 2 side to engage its tip with a screw head of the screw 4 which has reached the fastening acting position so that screw fastening can be performed, imparts turning force to the feed lever 24 to restore the feed lever 24 to a subsequent screw feed position, and imparts the turning force to the feed lever 24 in correspondence with a slide operation toward an original position to feed a subsequent screw 4 to the fastening acting position.

That is, the slide frame 31 includes a slide case 33 which is slidably fitted on an outer peripheral portion of the feed case 22, a slide guide opening section 34 which is bent into a chevron shape with a structure in which a straight portion and an oblique portion are connected is provided in a side surface portion of this slide case 33, and a feed roller 26 provided at an upper end portion of a feed lever 24 in the feed case 22 is arranged to come into slide contact with the slide guide opening section 34 of the slide case 33.

Figure 4:
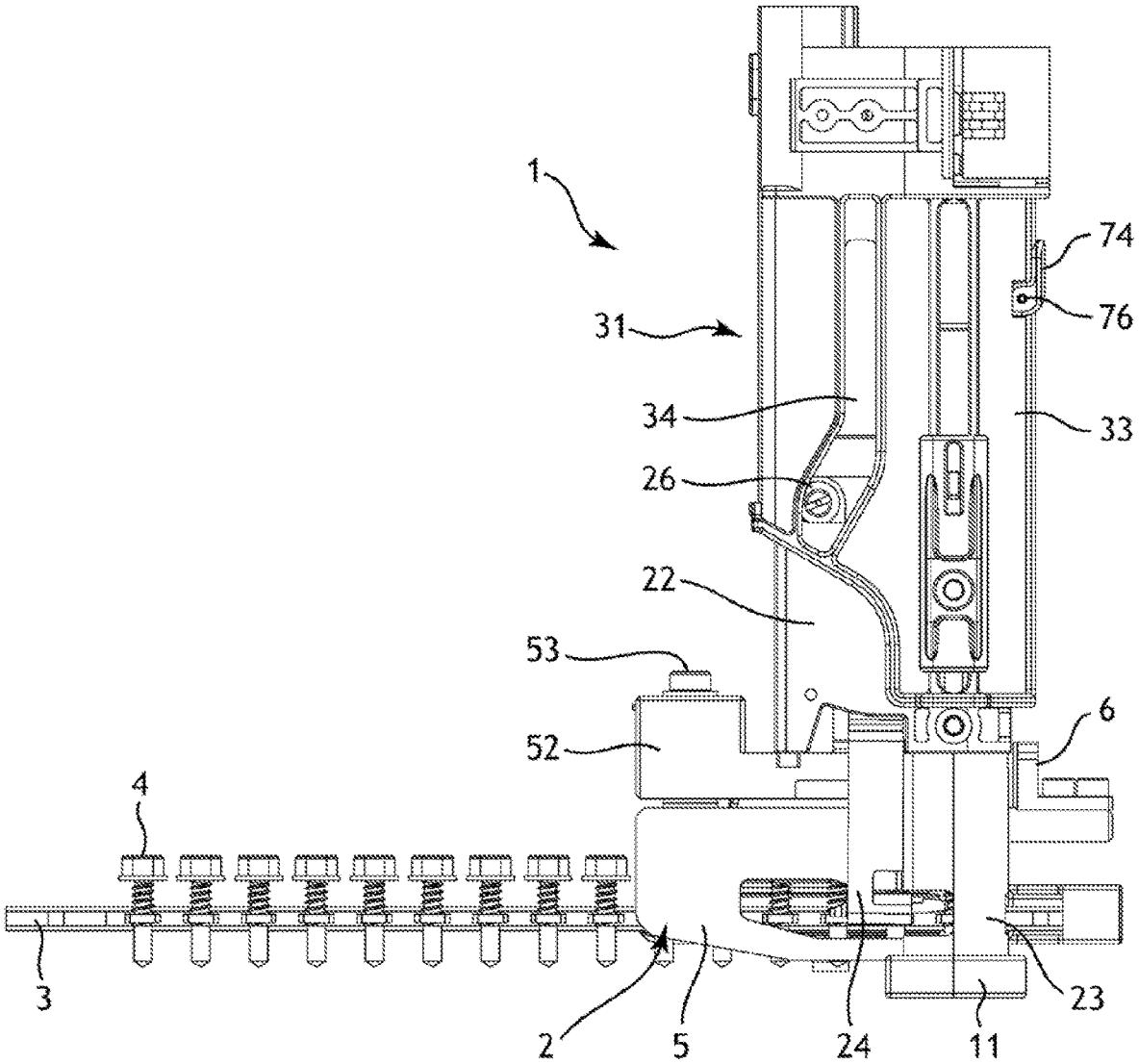
FIG. 4 is a schematic left side elevation of the screw feeding/fastening unit of the continuous screw fastening device according to the example.

Further, an upper end side of the feed lever 24 is turned around a shaft section 27 as a spindle toward a right side in FIG. 4 by engagement of the feed roller 26 and the oblique portion of the slide guide opening section 34 in correspondence with the slide operation of the slide frame 31 toward the screw strip guide unit 2, then this turned state is maintained by the engagement of the feed roller 26 and the straight portion, turning force and turned state maintaining force are thereby imparted to the feed lever 24, a tip of the bit 32 can be thus fitted to a screw head of the screw 4 to enable screw fastening, the tip side of the feed lever 24 is moved to a subsequent screw feed position, and a subsequent screw standby state begins.

Furthermore, the bit 32 is moved to its original position in correspondence with the slide operation of the slide case 33 toward its original position, the upper end side of the feed lever 24 is turned in a direction opposite to that described above, the turning force in the opposite direction is thereby imparted to the feed lever 24, the feed latch 25 is engaged with a side surface portion of a subsequent screw 4, and this subsequent screw 4 is fed to the fastening acting position to enable the screw fastening.

A screw strip binding piece unbinding mechanism section 51, a screw strip support mechanism section 61, and a bit/sleeve release mechanism section 71 provided in the screw feeding/fastening unit 1 of the continuous screw fastening device according to this example will now be individually described.

(Screw Strip Binding Piece Unbinding Mechanism Section 51)

The screw strip binding piece unbinding mechanism section 51 according to this example will now be described with reference to FIG. 1 and FIG. 4 to FIG. 7.

Figure 5:
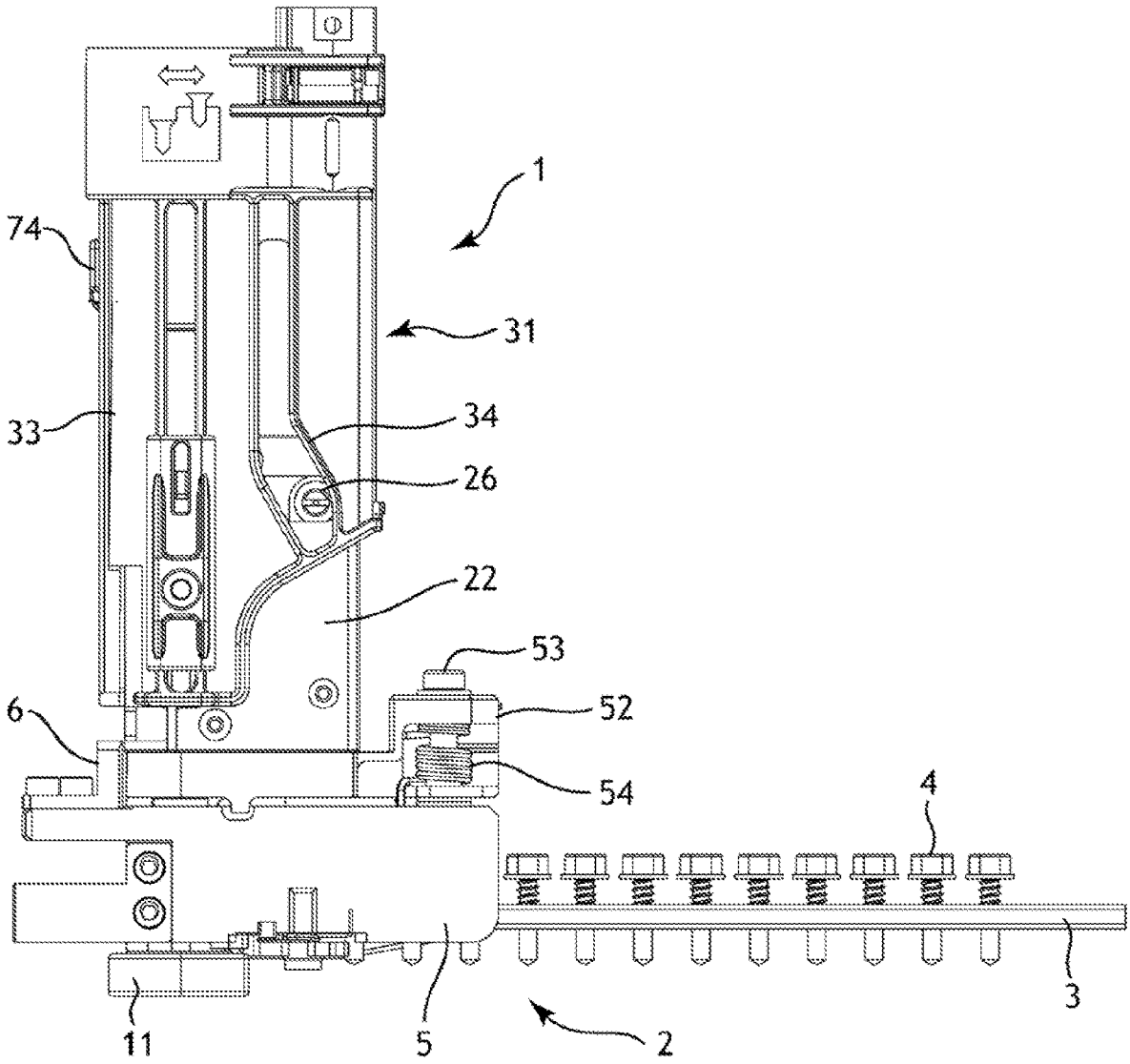
FIG. 5 is a schematic right side elevation of the screw feeding/fastening unit of the continuous screw fastening device according to the example.

As shown in FIG. 4 and FIG. 5, the screw strip binding piece unbinding mechanism section 51 includes a shaft guide body 52 integrally coupled with the feed case 22 above a screw strip inlet side of the screw strip guide unit 2, and the screw strip guide unit 2 is supported by a shaft body 53 provided to this shaft guide body 52 in such a manner that the screw strip guide unit 2 can turn in a direction orthogonal to the longitudinal direction of the bit 32.

Further, as shown in FIG. 5, the screw strip binding piece unbinding mechanism section 51 is configured in such a manner that the restoring force to the original position can act by a return spring 54 wound around the shaft body 53.

Furthermore, in the screw strip binding piece unbinding mechanism section 51, a turning receiver 6 which abuts on an abutting end portion 31*a* which is a part of the slide frame 31 and receives the turning force at the time of a slide operation of the slide frame 31 toward the screw strip guide unit 2 side is integrally provided to the screw strip guide unit 2.

Figure 6:
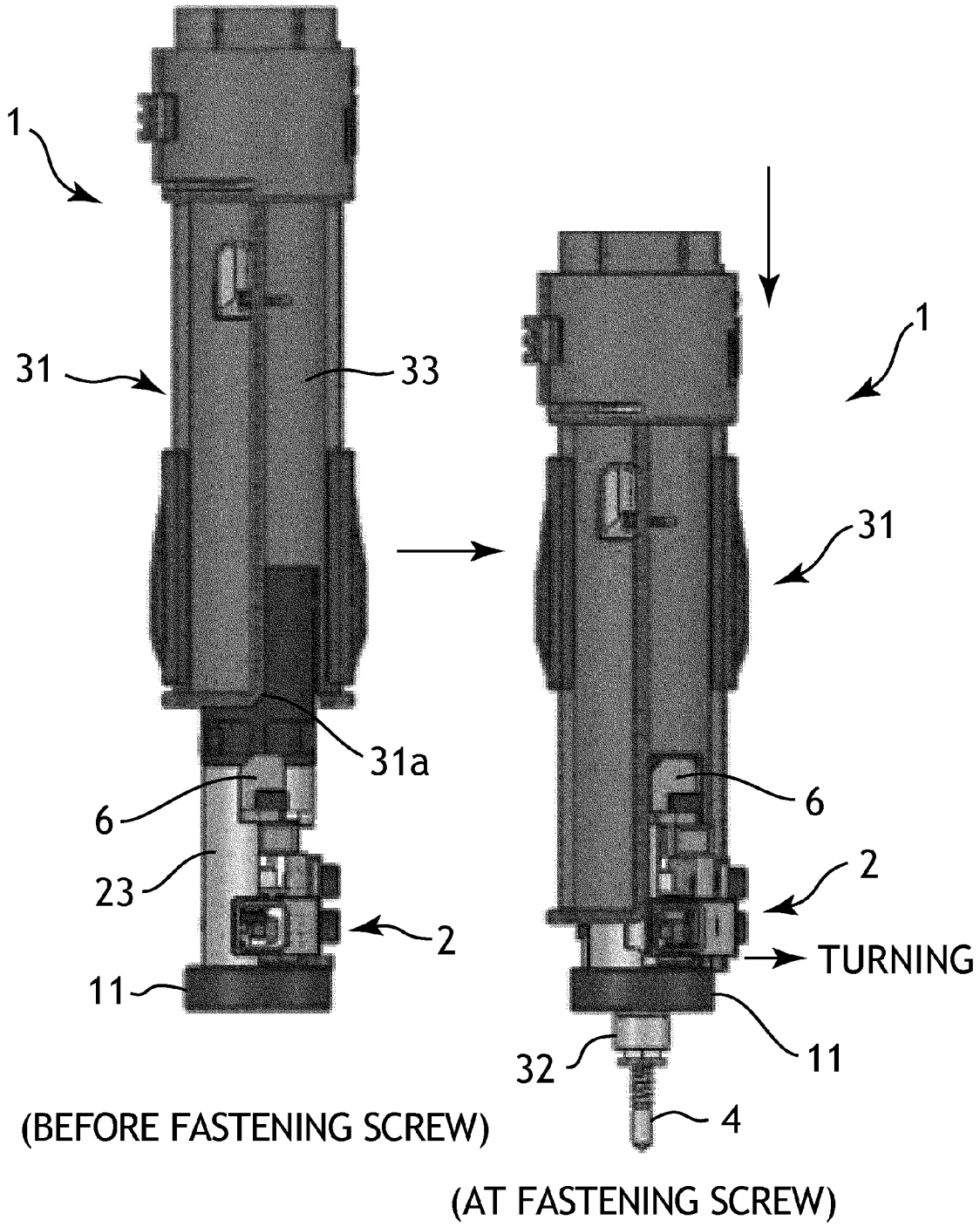
FIG. 6 is an operation explanatory drawing showing a slide operation state of a slide frame constituting a screw strip binding piece unbinding mechanism section in the screw feeding/fastening unit of the continuous screw fastening device according to the example.
Figure 7:
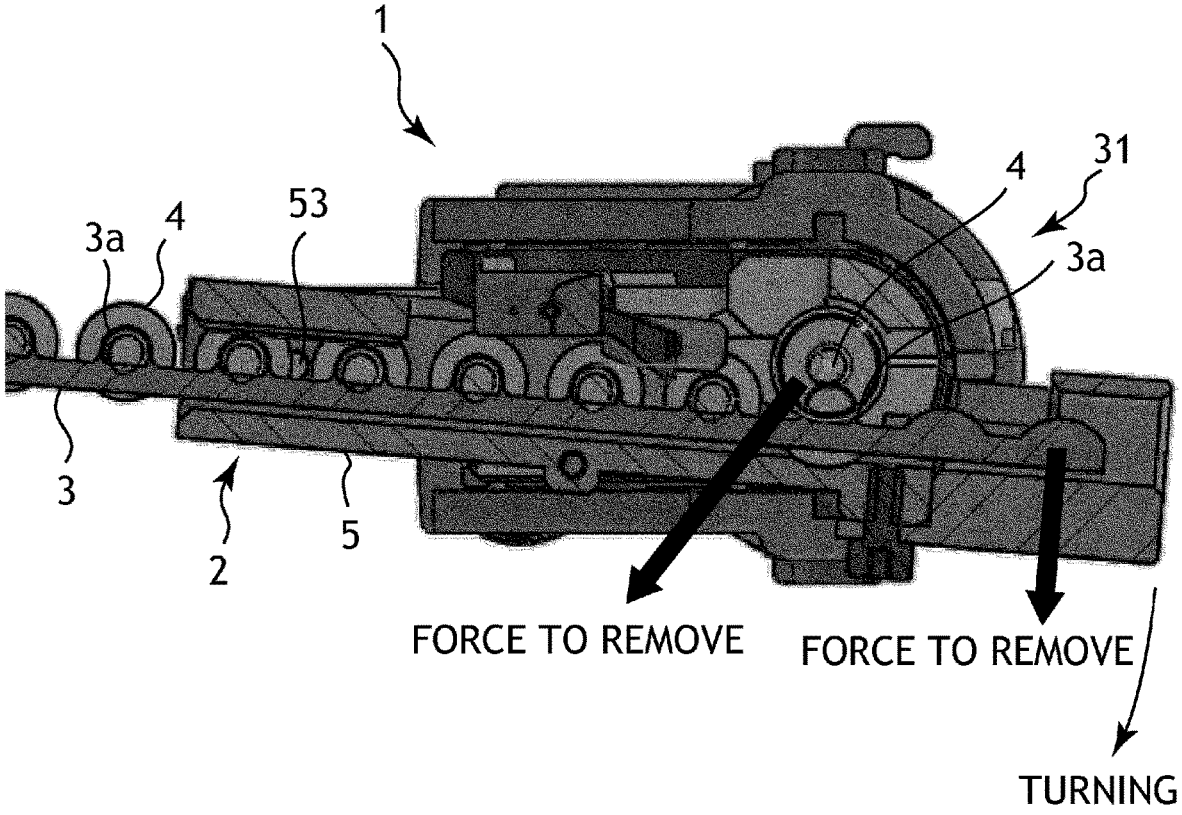
FIG. 7 is a schematic bottom view showing a turning state of a screw strip guide unit of the screw strip binding piece unbinding mechanism section corresponding to a slide operation of the slide frame in the screw feeding/fastening unit of the continuous screw fastening device according to the example.

Moreover, the slide frame 31 is slid toward the screw strip guide unit 2 side as shown in FIG. 6, the screw strip guide unit 2 is turned together with the turning receiver 6 around the shaft body 53 as a spindle in a direction along which its tip side moves away from the screw 4 as shown in FIG. 7 at the time of fastening the screw 4 at the fastening acting position by the bit 32, and unbinding force is thereby imparted to a screw strip binding piece 3*a* which binds the screw 4 at the fastening acting position.

According to the screw binding piece unbinding mechanism section 51 of this example, even in case of using a hexagonal screw or a wafer screw whose head portion has a flat bearing surface, as the screw 4, the screw strip binding piece 3*a* can be accurately pulled out of the screw 4 at the fastening acting position, and screw fastening can be assuredly performed at a target position.

In a normal attachment incorporating a feeder unit, a screw strip guide unit, and others in each of conventional examples, when screws each having a hexagonal head or a wafer head whose head portion has a flat bearing surface are used, there is, e.g., an inconvenience that the flat bearing surface of the head portion of the screw is caught by the screw strip 3 to disable screw fastening or the screw strip 3 is deformed to cause a problem.

(Screw Strip Support Mechanism Section 61)

The screw strip support mechanism section 61 according to this example will now be described with reference to FIG. 3 and FIG. 8 to FIG. 11.

Figure 3:
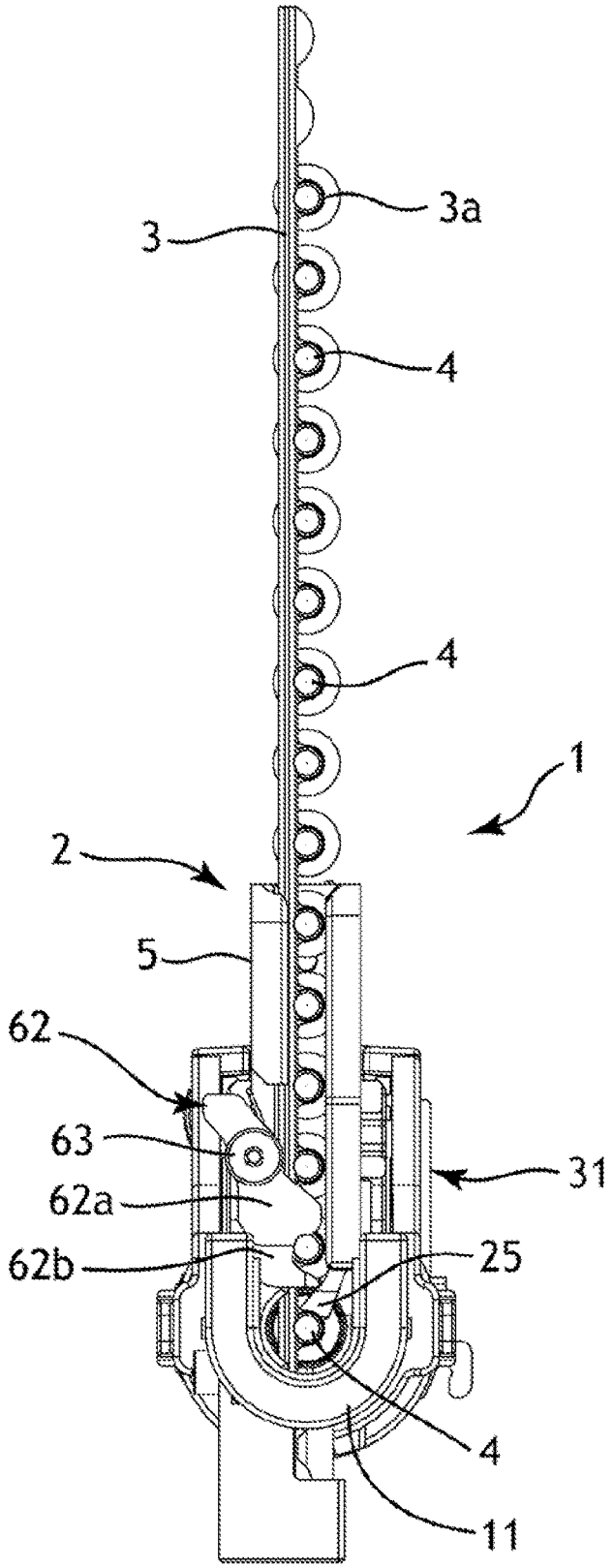
FIG. 3 is a schematic bottom view of the screw feeding/fastening unit of the continuous screw fastening device according to the example.
Figure 8:
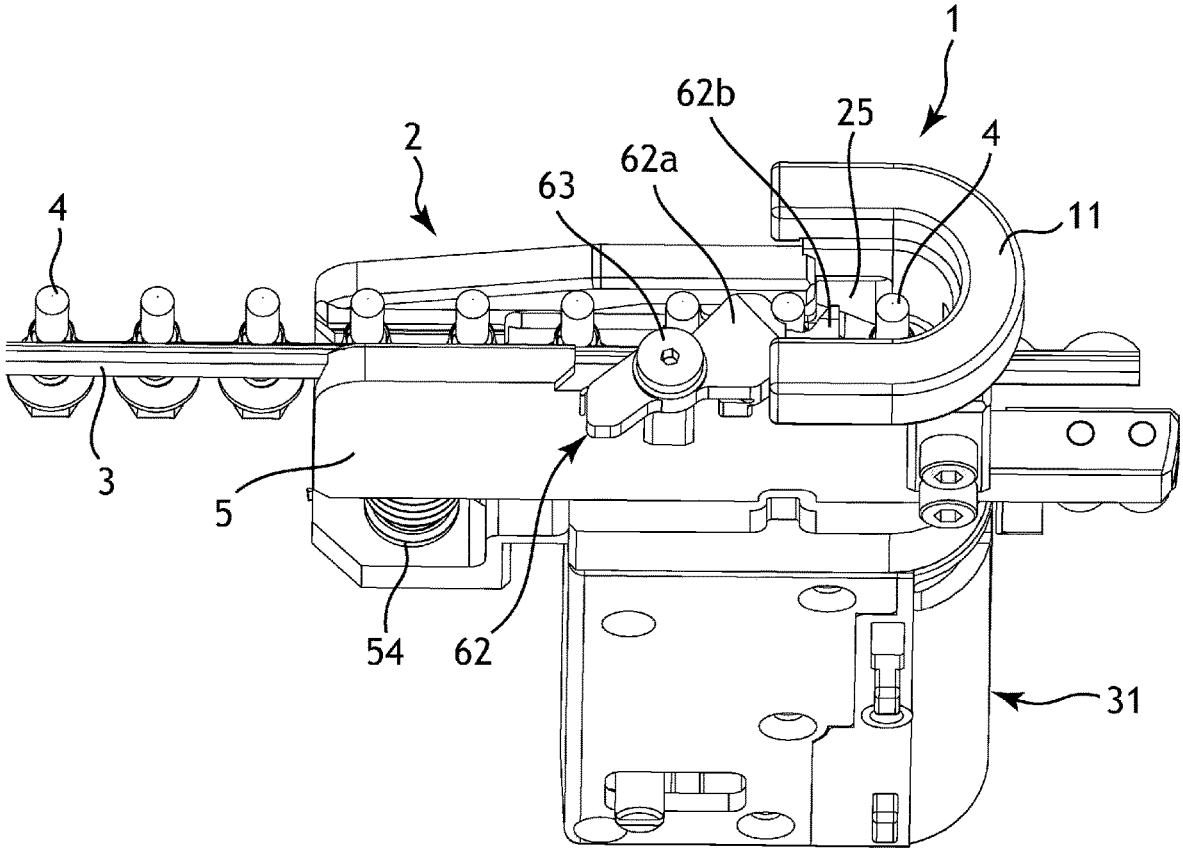
FIG. 8 is a schematic perspective view showing a supported state of a bottom of a screw trip realized by a turning claw body of a screw strip support mechanism section in the screw feeding/fastening unit of the continuous screw fastening device according to the example.
Figure 9:
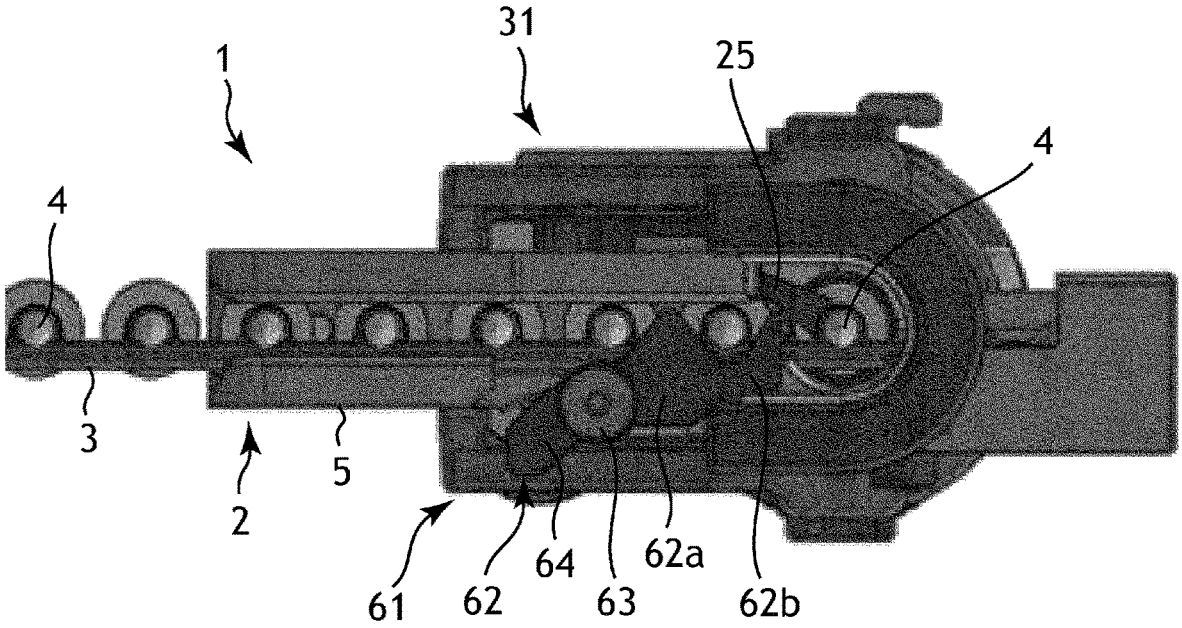
FIG. 9 is a schematic bottom view showing the supported state of the bottom of the screw trip realized by the turning claw body of the screw strip support mechanism section in the screw feeding/fastening unit of the continuous screw fastening device according to the example.

As shown in FIG. 8, FIG. 9, and FIG. 3, the screw strip support mechanism section 61 according to this example is constituted of a turning claw body 62 which is turnably supported by a turning claw body support shaft 63 disposed to a bottom portion of the screw strip guide unit 2 and configured in such a manner that the restoring force to an original position can act by an action of spring force provided by a coil spring 64.

Figure 10:
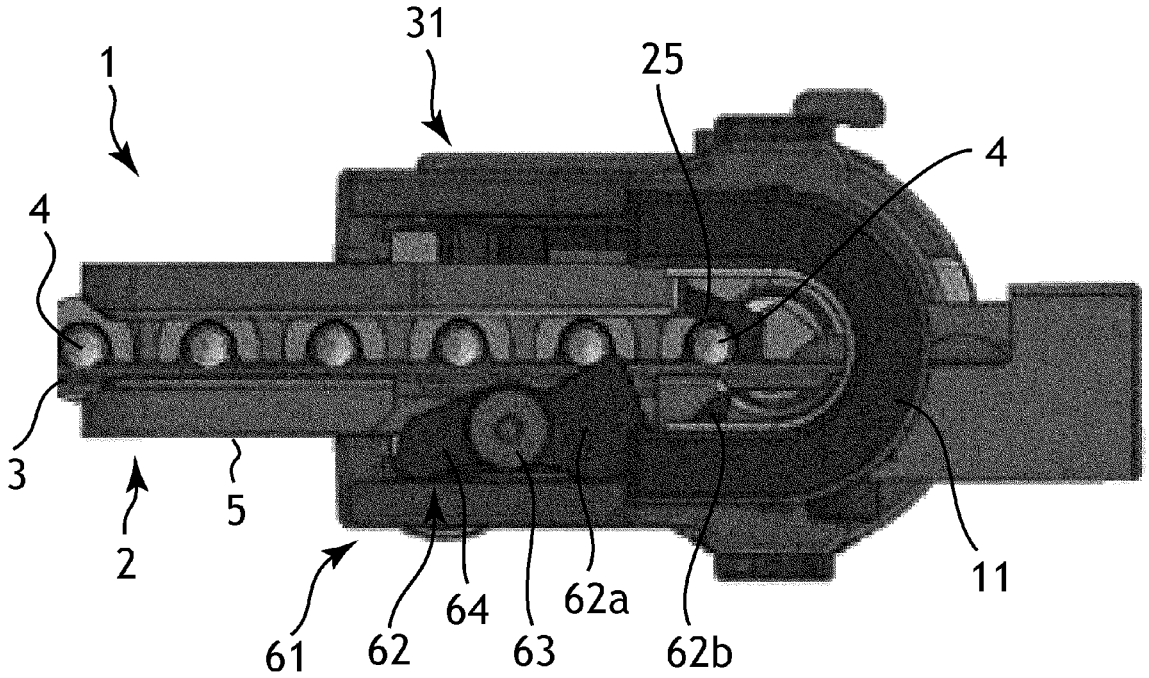
FIG. 10 is a schematic bottom view showing a turning state of the turning claw body at the time of screw feeding of the screw strip support mechanism section in the screw feeding/fastening unit of the continuous screw fastening device according to the example.

The turning claw body 62 includes a claw body base section 62*a* which abuts on a sidewall portion of the screw 4 and receives the turning force to retract from a path of the screw 4 as shown in FIG. 10 at the time of screw feeding performed by the feeder unit 21 and abuts on and supports the bottom of the screw strip 3 between the screws 4 adjacent to each other at the time of finishing the screw feeding, and an abutting claw piece 62*b* which abuts on and supports the bottom of the screw strip 3 near the fastening acting position integrally provided at a protruding end of this craw body base section 62*a*.

Figure 11:
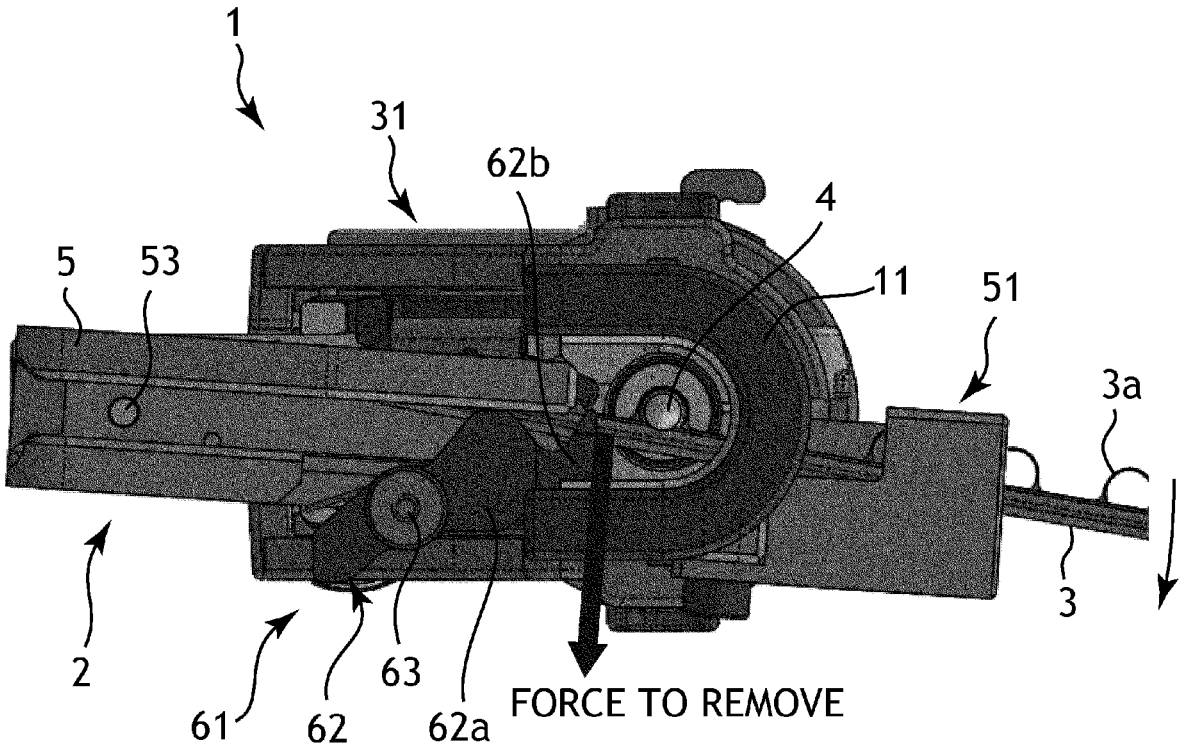
FIG. 11 is a schematic bottom view showing a cooperating state of turning of a screw strip guide unit of the screw strip binding piece unbinding mechanism section and support of the bottom of the screw strip performed by the turning claw body of the screw strip support mechanism section in the screw feeding/fastening unit of the continuous screw fastening device according to the example.

According to the screw strip support mechanism section 61 of this example, since the abutting claw piece 62*b* which abuts on and supports the bottom of the screw strip 3 near the fastening acting position integrally provided to the protruding end of the claw body base section 62*a* is included, each screw 4 bound to the screw strip 3 as well as the last coupled screw 4 can be accurately fastened to a target position in cooperation with the operation of turning the screw strip guide unit 2 together with the turning receiver 6 around the shaft body 53 as a spindle in the direction along which its tip side moves away from the screw 4 by the screw strip binding piece unbinding mechanism section 51 as shown in FIG. 11.

That is, tearing off the screw strip binding piece 3*a* of the screw strip 3 is tried by an operation of the screw strip binding piece unbinding mechanism section 51, but the screw strip cannot be held by a screw 4 following a last coupled screw 4 due to absence of such a subsequent screw 4, the screw strip binding piece 3*a* cannot be assuredly torn off, and the screw fastening is impossible.

However, when the screw strip support mechanism section 61 according to this example is simultaneously used as shown in FIG. 11, the bottom of the screw strip 3 can abut on and can be supported by the abutting claw piece 62*b* in the vicinity of the fastening acting position at the time of fastening the last coupled screw 4, two power points of unbinding force to the screw strip binding piece 3*a* are thereby provided in relation to the last coupled screw 4, the screw strip binding piece 3*a* can be assuredly torn off, and the screw fastening can be accurately and smoothly performed to a target position.

Besides, according to the screw strip support mechanism section 61 of this example, since the craw body base section 62*a* which abuts on and supports the bottom of the screw strip between the screws 4 which are adjacent to each other at a position before the abutting claw piece 62 at the end of screw feeding is provided, a function to prevent the screw 4 bound by the screw strip 3 from coming off in a region before the fastening acting position can be also exerted.

(Bit/Sleeve Release Mechanism Section 71)

The bit/sleeve release mechanism section 71 according to this example will now be described with reference to FIG. 12 to FIG. 16.

Figure 12:
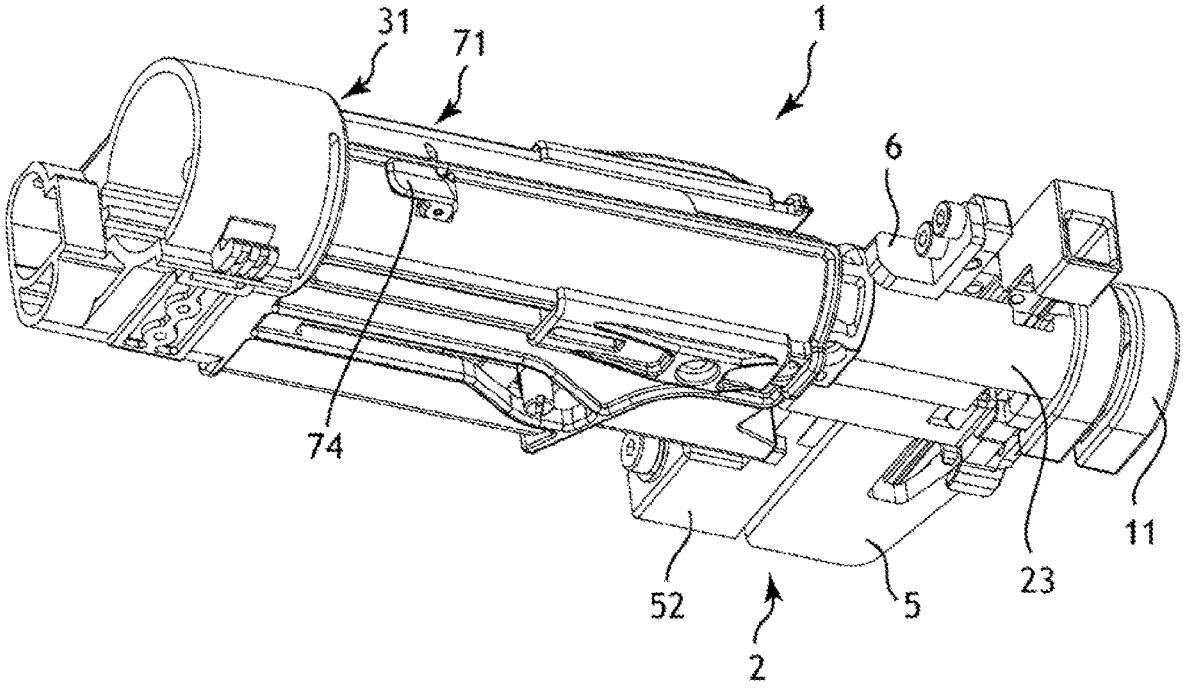
FIG. 12 is a schematic perspective view showing a slide frame, a sleeve release lever constituting a bit/sleeve release mechanism section, the screw strip guide unit, a feeder unit, and a target abutting body in the screw feeding/fastening unit of the continuous screw fastening device according to the example.
Figure 13:
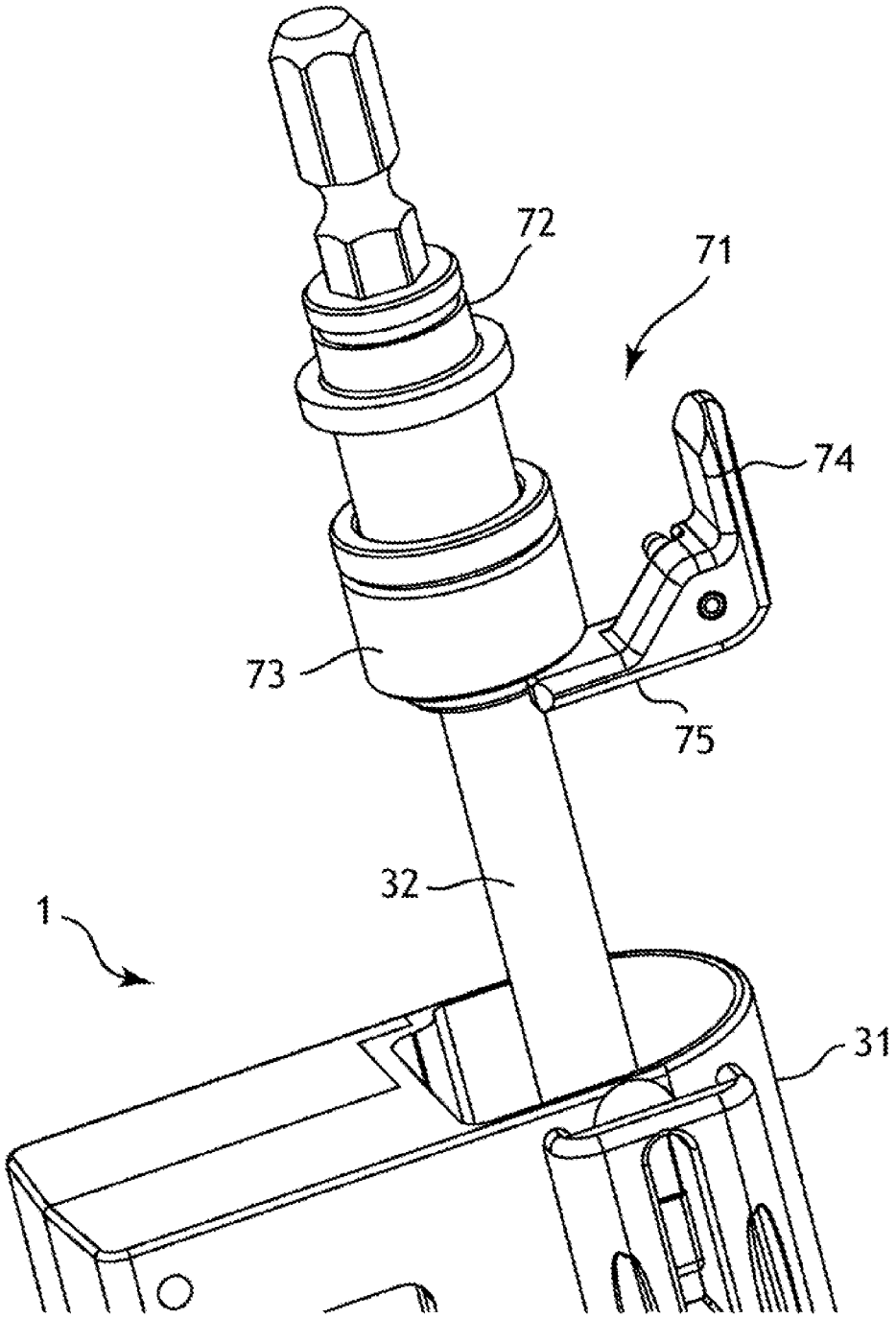
FIG. 13 is a partially enlarged perspective view showing an engagement state of the sleeve release lever constituting the bit/sleeve release mechanism section, a sleeve, and the bit coupled with a socket in the screw feeding/fastening device of the continuous screw fastening device according to the example.

The bit/sleeve release mechanism section 71 according to this example includes a sleeve release lever 74 which detachably couples the bit 32 through a sleeve 73 disposed to a socket 72 attached to a rotation main shaft body of the driver 41 in the side frame 31 and turns around a shaft 76 as a spindle arranged on an outer wall portion of the slide frame 31 to be manually operable as shown in FIG. 12 and FIG. 13, and a sleeve release piece 75 shown in FIG. 13 which uncouples the bit 32 and the sleeve 73 from each other in the slide frame 31 in correspondence with an operation of this sleeve release lever 74.

It is to be noted that the sleeve release lever 74 includes a spring which enables restoration to an original position after releasing a manual operation, but this member is omitted in the drawing.

Figure 14:
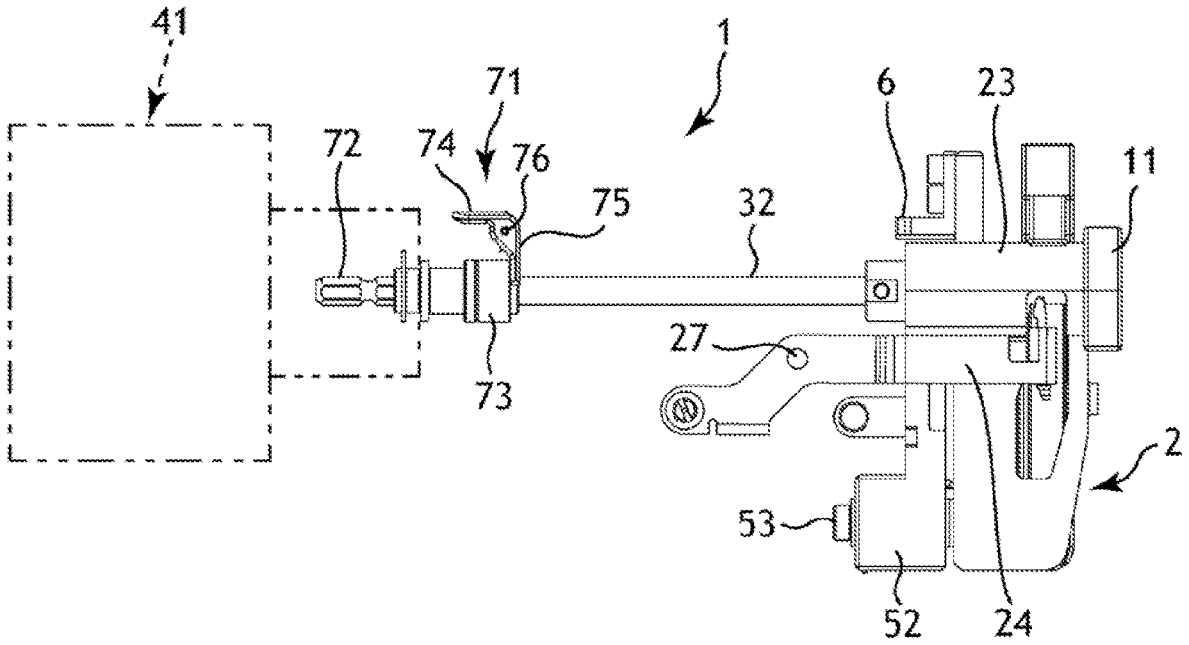
FIG. 14 is a partially enlarged explanatory drawing showing arrangement of the sleeve release lever constituting the bit/sleeve release mechanism section, the sleeve, the bit coupled with the socket, the feeder unit, the screw strip guide unit, and the target abutting body in a steady state in the screw feeding/fastening unit of the continuous screw fastening device according to the example.
Figure 15:
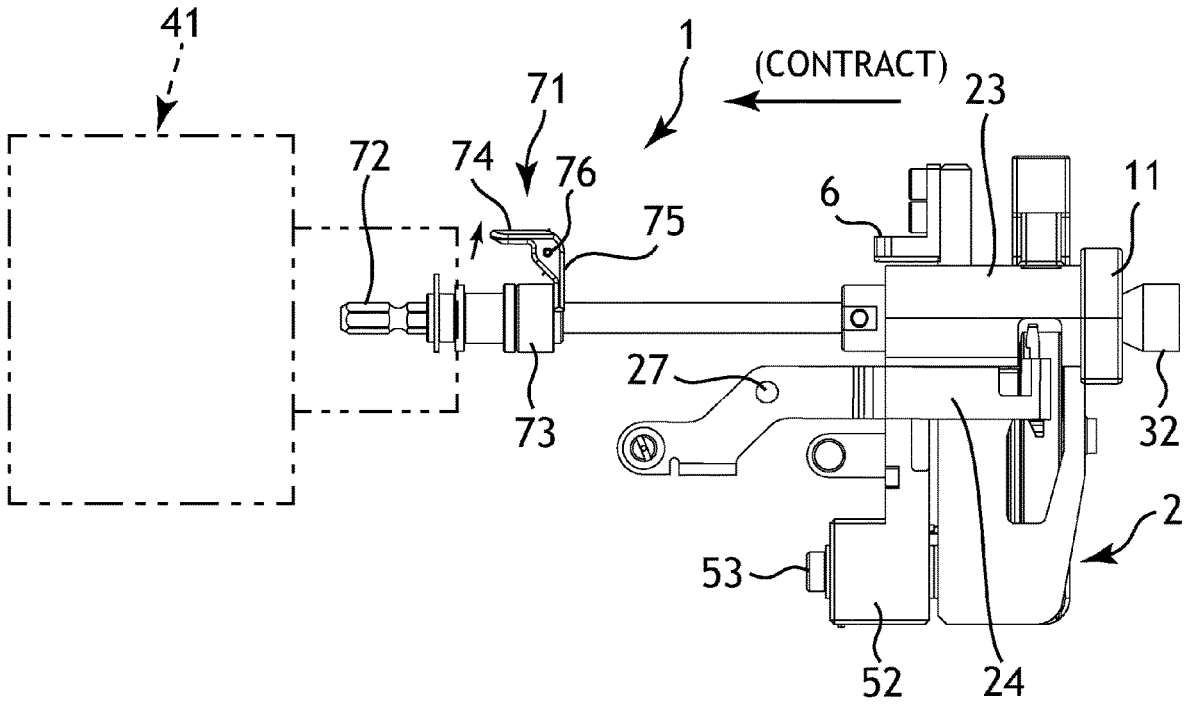
FIG. 15 is a partially enlarged explanatory drawing showing arrangement in which the feeder unit and the screw strip guide unit are slid to the sleeve release lever and sleeve side and a tip side of the bit is protruded to the outside of the target abutting body in the sleeve release lever constituting the bit/sleeve release mechanism section, the sleeve, the bit coupled with the socket, the feeder unit, the screw strip guide unit, and the target abutting body in the screw feeding/fastening unit of the continuous screw fastening device according to the example.

In the bit/sleeve release mechanism section 71 according to this example, as shown in FIG. 14 and FIG. 15, the feeder unit 21, the screw strip guide unit 2, and the target abutting body 11 are slid (contracted) toward the driver 41 side from a normal position, and the tip side of the bit 32 is thereby protruded toward the outside of the target abutting body 11.

Further, in this state, when the sleeve release lever 74 is manually operated in an arrow direction shown in FIG. 15, the sleeve release piece 75 pushes a portion of the sleeve 73 which is coupled with the bit 32 toward the socket 72 side in the slide frame 31.

Figure 16:
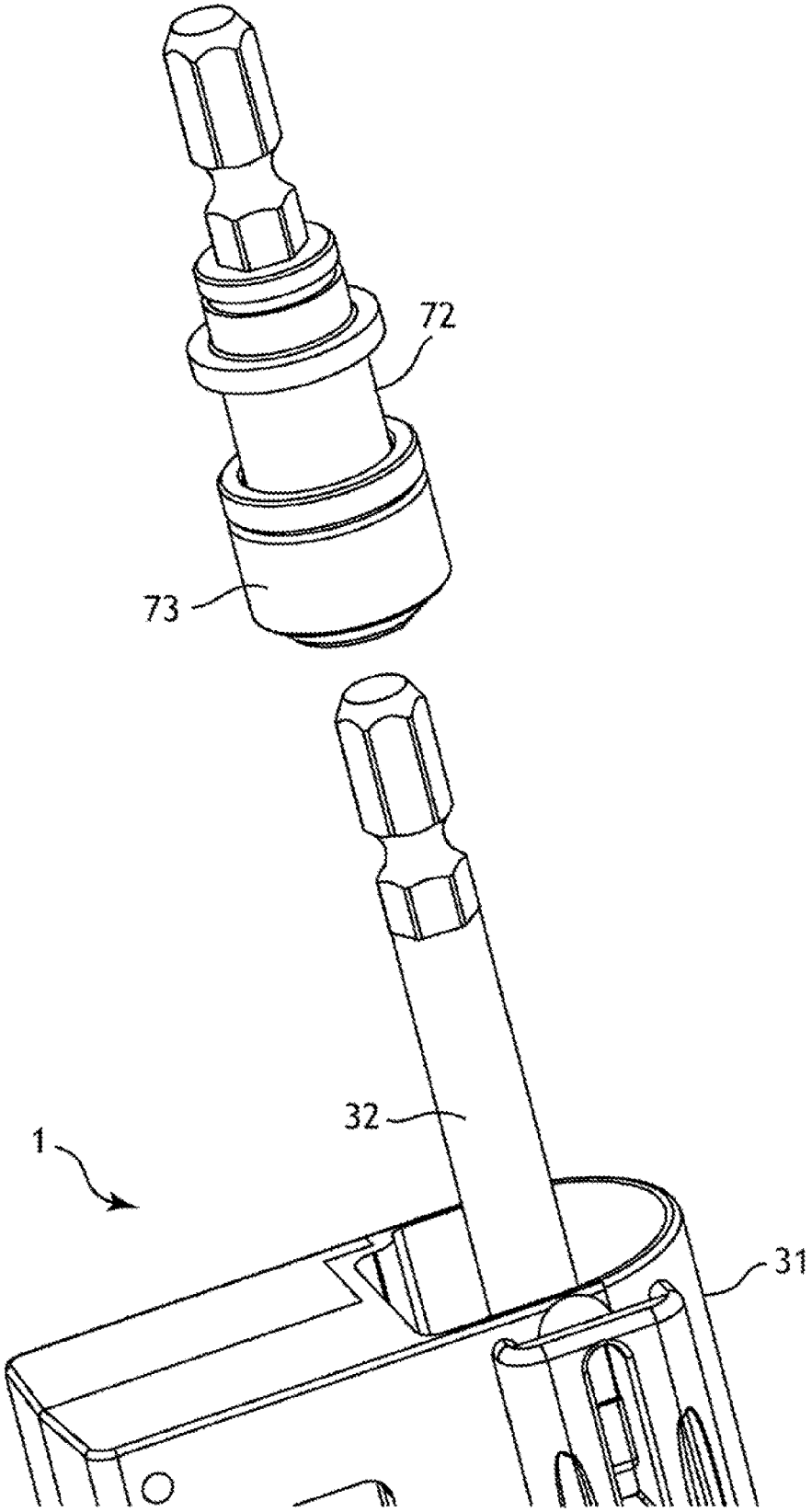
FIG. 16 is an enlarged explanatory drawing conceptually showing a mode in which the bit is uncoupled from the sleeve by an operation of the sleeve release lever in the bit/sleeve release mechanism section in the screw feeding/fastening unit of the continuous screw fastening device according to the example.

Consequently, sliding the feeder unit 21, the screw strip guide unit 2, the target abutting body 11 toward the driver 41 side from the normal position and then performing a single operation of the sleeve release lever 74 enables easily uncoupling the bit 32 and the sleeve 73 from each other, and the bit 32 and the sleeve 73 are separated from each other as conceptually shown in FIG. 16.

Consequently, the bit 32 can be removed to the outside from the target abutting body 11 side with excellent workability without requiring a troublesome operation, i.e. removing the screw feeding/fastening unit 1 itself from the driver 41.

That is, even in case of using a hexagonal bit as the bit 32, attachment/detachment of this bit 32 can be easily performed, and newly attaching a hexagonal bit having a different size can be facilitated.

At the time of attaching a new bit 32, just manually operating the sleeve release lever 74 in the arrow direction shown in FIG. 15 to insert the bit 32 into the sleeve 73 and restoring the sleeve release lever 74 to its original position enables simply and easily performing this attachment.

In a normal attachment having a configuration incorporating a feeder unit, a screw strip guide unit, and others in each conventional example, when a cross (Phillips) bit or a square bit is used, the bit can be replaced in a state where the attachment has been removed from the driver, but both the bit and socket must be disposed to the attachment in advance due to a large diameter of a tip of the hexagonal bit, and hence a very troublesome bit replacement operation is required in such a configuration.

INDUSTRIAL APPLICABILITY

The screw feeding/fastening unit according to the present invention can be extensively applied for a screw fastening device which continuously fastens screws to fix a plate material, e.g., a wooden board or a metal plate to a wall surface, a floor surface, or the like and is newly fabricated and for a screw fastening device which uses an existing driver.

The invention claimed is:

1. A screw feeding/fastening unit of a continuous screw fastening device, comprising:

a screw strip guide unit which guides many screws bound to a screw strip at predetermined intervals to a fastening acting position for a target, and leads a part of the screw strip subjected to screw fastening forward for discharge;

a target abutting body configured to enable piercing a screw to be fastened therethrough which is arranged immediately below the fastening acting position;

a feeder unit which comprises in a coupling arrangement a feed case arranged above the screw strip guide unit and a guide tube which is arranged on one lateral side of the screw strip guide unit and has a lower portion coupled with the target abutting body, and which comprises a turnable feed lever for screw feeding which is arranged to reach the vicinity of the fastening acting position from the inside of the feed case through an outer surface of the screw strip guide unit; and a slide frame to which a screw fastening driver is attached from above, into which a bit coupled with a rotation main shaft body of the driver is inserted and which is slidably fitted to the feed case, engages a tip of the bit with a screw head at the fastening acting position to enable screw fastening in correspondence with a slide operation toward the screw strip guide unit side, imparts turning force to the feed lever to return it to a subsequent screw feed position, and imparts the turning force the feed lever to feed a subsequent screw to the fastening acting position in correspondence with a slide operation toward an original position, wherein the screw feeding/fastening unit of the continuous screw fastening device comprises a screw strip binding piece unbinding section which supports the screw strip guide unit to be turnable in a direction orthogonal to a longitudinal direction of the bit by a shaft body provided at a position before the feed case of the feeder unit and to be restorable to its original position by a spring, has on the screw strip guide unit a turning receiver which abuts on a part of the slide frame and receives turning force at the time of a slide operation of the slide frame toward the screw strip guide unit, and turns the screw strip guide unit together with the turning receiver around the shaft body as a spindle in a direction along which a tip side gets away from a screw at the fastening acting position to impart unbinding force to the screw strip binding piece at the time of fastening the screw.

2. A screw feeding/fastening unit of a continuous screw fastening device, comprising:

a screw strip guide unit which guides many screws bound to a screw strip at predetermined intervals to a fastening acting position for a target, and leads a part of the screw strip subjected to screw fastening forward for discharge;

a target abutting body configured to enable piercing a screw to be fastened therethrough which is arranged immediately below the fastening acting position;

a feeder unit which comprises in a coupling arrangement a feed case arranged above the screw strip guide unit and a guide tube which is arranged on one lateral side of a screw strip guide unit and has a lower portion coupled with the target abutting body, and which comprises a turnable feed lever for screw feeding which is arranged to reach the vicinity of the fastening acting position from the inside of the feed case through an outer surface of the screw strip guide unit; and a slide frame to which a screw fastening driver is attached from above, into which a bit coupled with a rotation main shaft body of the driver is inserted and which is slidably fitted to the feed case, engages a tip of the bit with a screw head at the fastening acting position to enable screw fastening in correspondence with a slide operation toward the screw strip guide unit side, imparts turning force to the feed lever to return it to a subsequent screw feed position, and imparts the turning force the feed lever to feed a subsequent screw to the fastening acting position in correspondence with a slide operation toward an original position, wherein the screw feeding/fastening unit of the continuous screw fastening device comprises, on a bottom portion of the screw strip guide unit, a screw strip support mechanism section formed of a turning claw body which is supported to be turnable by an action of spring force, retracts from a path of the screws at the time of screw feeding performed by the feeder unit, abuts on and supports a bottom of the screw strip between screws which are adjacent to each other at the end of the screw feeding, and comprises at a protruding end an abutting claw piece which abuts on and supports the bottom of the screw strip near the fastening acting position.

3. A screw feeding/fastening unit of a continuous screw fastening device, comprising:

a screw strip guide unit which guides many screws bound to a screw strip at predetermined intervals to a fastening acting position for a target, and leads a part of the screw strip subjected to screw fastening forward for discharge;

a target abutting body configured to enable piercing a screw to be fastened therethrough which is arranged immediately below the fastening acting position;

a feeder unit which comprises in a coupling arrangement a feed case arranged above the screw strip guide unit and a guide tube which is arranged on one lateral side of a screw strip guide unit and has a lower portion coupled with the target abutting body, and which comprises a turnable feed lever for screw feeding which is arranged to reach the vicinity of the fastening acting position from the inside of the feed case through an outer surface of the screw strip guide unit; and a slide frame to which a screw fastening driver is attached from above, into which a bit coupled with a rotation main shaft body of the driver is inserted, and which is slidably fitted to the feed case, engages a tip of the bit with a screw head at the fastening acting position to enable screw fastening in correspondence with a slide operation toward the screw strip guide unit side, imparts turning force to the feed lever to return it to a subsequent screw feed position, and imparts the turning force the feed lever to feed a subsequent screw to the fastening acting position in correspondence with a slide operation toward an original position, wherein the screw feeding/fastening unit of the continuous screw fastening device comprises:

a screw strip binding piece unbinding mechanism section which supports the screw strip guide unit to be turnable in a direction orthogonal to a longitudinal direction of the bit by a shaft body provided at a position before the feed case of the feeder unit and to be restorable to its original position by a spring, has on the screw strip guide unit a turning receiver which abuts on a part of the slide frame and receives turning force at the time of a slide operation of the slide frame toward the screw strip guide unit, and turns the screw strip guide unit together with the turning receiver around the shaft body as a spindle in a direction along which a tip side gets away from a screw at the fastening acting position to impart unbinding force to the screw strip binding piece at the time of fastening the screw; and a screw strip support mechanism section provided on a bottom portion of the screw strip guide unit and formed of a turning claw body which is supported to be turnable by an action of spring force, retracts from a path of the screws at the time of screw feeding performed by the feeder unit, abuts on and supports a bottom of the screw strip between screws which are adjacent to each other at the end of the screw feeding, and comprises at a protruding end an abutting claw piece which abuts on and supports the bottom of the screw strip near the fastening acting position.

4. A screw feeding/fastening unit of a continuous screw fastening device, comprising:

a screw strip guide unit which guides many screws bound to a screw strip at predetermined intervals to a fastening acting position for a target, and leads a part of the screw strip subjected to screw fastening forward for discharge;

a target abutting body configured to enable piercing a screw to be fastened therethrough which is arranged immediately below the fastening acting position;

a feeder unit which comprises in a coupling arrangement a feed case arranged above the screw strip guide unit and a guide tube which is arranged on one lateral side of the screw strip guide unit and has a lower portion coupled with the target abutting body, and which comprises a turnable feed lever for screw feeding which is arranged to reach the vicinity of the fastening acting position from the inside of the feed case through an outer surface of the screw strip guide unit; and a slide frame to which a screw fastening driver is attached from above, into which a bit coupled with a rotation main shaft body of the driver is inserted, and which is slidably fitted to the feed case, engages a tip of the bit with a screw head at the fastening acting position to enable screw fastening in correspondence with a slide operation toward the screw strip guide unit side, imparts turning force to the feed lever to return it to a subsequent screw feed position, and imparts the turning force the feed lever to feed a subsequent screw to the fastening acting position in correspondence with a slide operation toward an original position, wherein the screw feeding/fastening unit of the continuous screw fastening device comprises:

a screw strip support mechanism section provided on a bottom portion of the screw strip guide unit and formed of a turning claw body which is supported to be turnable by an action of spring force, retracts from a path of the screws at the time of screw feeding performed by the feeder unit, abuts on and supports a bottom of the screw strip between screws which are adjacent to each other at the end of the screw feeding, and comprises at a protruding end an abutting claw piece which abuts on and supports the bottom of the screw strip near the fastening acting position; and a bit/sleeve release mechanism section to which the bit is detachably coupled through a sleeve disposed to a socket directly connected to the rotation main shaft body of the driver in the slide frame, and which comprises a sleeve release lever which is arranged on an outer wall portion of the slide frame to enable a manual operation and a sleeve release piece which uncouples the bit and the sleeve from each other in correspondence with an operation of the sleeve release lever.

5. A screw feeding/fastening unit of a continuous screw fastening device, comprising:

a screw strip guide unit which guides many screws bound to a screw strip at predetermined intervals to a fastening acting position for a target, and leads a part of the screw strip subjected to screw fastening forward for discharge;

a target abutting body configured to enable piercing a screw to be fastened therethrough which is arranged immediately below the fastening acting position;

a feeder unit which comprises in a coupling arrangement a feed case arranged above the screw strip guide unit and a guide tube which is arranged on one lateral side of the screw strip guide unit and has a lower portion coupled with the target abutting body, and which comprises a turnable feed lever for screw feeding which is arranged to reach the vicinity of the fastening acting position from the inside of the feed case through an outer surface of the screw strip guide unit; and a slide frame to which a screw fastening driver is attached from above, into which a bit coupled with a rotation main shaft body of the driver is inserted, and which is slidably fitted to the feed case, engages a tip of the bit with a screw head at the fastening acting position to enable screw fastening in correspondence with a slide operation toward the screw strip guide unit side, imparts turning force to the feed lever to return it to a subsequent screw feed position, and imparts the turning force the feed lever to feed a subsequent screw to the fastening acting position in correspondence with a slide operation toward an original position, wherein the screw feeding/fastening unit of the continuous screw fastening device comprises:

a screw strip binding piece unbinding section which supports the screw strip guide unit to be turnable in a direction orthogonal to a longitudinal direction of the bit by a shaft body provided at a position before the feed case of the feeder unit and to be restorable to its original position by a spring, has on the screw strip guide unit a turning receiver which abuts on a part of the slide frame and receives turning force at the time of a slide operation of the slide frame toward the screw strip guide unit, and turns the screw strip guide unit together with the turning receiver around the shaft body as a spindle in a direction along which a tip side gets away from a screw at the fastening acting position to impart unbinding force to the screw strip binding piece at the time of fastening the screw; and a bit/sleeve release mechanism section to which the bit is detachably coupled through a sleeve disposed to a socket directly connected to the rotation main shaft body of the driver in the slide frame, and which comprises a sleeve release lever which is arranged on an outer wall portion of the slide frame to enable a manual operation and a sleeve release piece which uncouples the bit and the sleeve from each other in correspondence with an operation of the sleeve release lever.

6. A screw feeding/fastening unit of a continuous screw fastening device, comprising:

a screw strip guide unit which guides many screws bound to a screw strip at predetermined intervals to a fastening acting position for a target, and leads a part of the screw strip subjected to screw fastening forward for discharge;

a target abutting body configured to enable piercing a screw to be fastened therethrough which is arranged immediately below the fastening acting position;

a feeder unit which comprises in a coupling arrangement a feed case arranged above the screw strip guide unit and a guide tube which is arranged on one lateral side of the screw strip guide unit and has a lower portion coupled with the target abutting body, and which comprises a turnable feed lever for screw feeding which is arranged to reach the vicinity of the fastening acting position from the inside of the feed case through an outer surface of the screw strip guide unit; and a slide frame to which a screw fastening driver is attached from above, into which a bit coupled with a rotation main shaft body of the driver is inserted, and which is slidably fitted to the feed case, engages a tip of the bit with a screw head at the fastening acting position to enable screw fastening in correspondence with a slide operation toward the screw strip guide unit side, imparts turning force to the feed lever to return it to a subsequent screw feed position, and imparts the turning force the feed lever to feed a subsequent screw to the fastening acting position in correspondence with a slide operation toward an original position, wherein the screw feeding/fastening unit of the continuous screw fastening device comprises:

a screw strip binding piece unbinding section which supports the screw strip guide unit to be turnable in a direction orthogonal to a longitudinal direction of the bit by a shaft body provided at a position before the feed case of the feeder unit and to be restorable to its original position by a spring, has on the screw strip guide unit a turning receiver which abuts on a part of the slide frame and receives turning force at the time of a slide operation of the slide frame toward the screw strip guide unit, and turns the screw strip guide unit together with the turning receiver around the shaft body as a spindle in a direction along which a tip side gets away from a screw at the fastening acting position to impart unbinding force to the screw strip binding piece at the time of fastening the screw;

a screw strip support mechanism section provided on a bottom portion of the screw strip guide unit and formed of a turning claw body which is supported to be turnable by an action of spring force, retracts from a path of the screws at the time of screw feeding performed by the feeder unit, abuts on and supports a bottom of the screw strip between screws which are adjacent to each other at the end of the screw feeding, and comprises at a protruding end an abutting claw piece which abuts on and supports the bottom of the screw strip near the fastening acting position; and a bit/sleeve release mechanism section to which the bit is detachably coupled through a sleeve disposed to a socket directly connected to the rotation main shaft body of the driver in the slide frame, and which comprises a sleeve release lever which is arranged on an outer wall portion of the slide frame to enable a manual operation and a sleeve release piece which uncouples the bit and the sleeve from each other in correspondence with an operation of the sleeve release lever.

* * * * *